United States Patent [19]

Judkins

[11] Patent Number: 4,735,030

[45] Date of Patent: Apr. 5, 1988

[54] SUPPORT CLIP FOR CEILING CONSTRUCTIONS

[75] Inventor: Thomas Judkins, Baltimore, Md.

[73] Assignee: The Judkins Associations, Inc., Baltimore, Md.

[21] Appl. No.: 910,474

[22] Filed: Sep. 23, 1986

[51] Int. Cl.[4] ..... E04B 2/00

[52] U.S. Cl. ..... 52/762; 52/489; 52/665; 403/387

[58] Field of Search ..... 52/200, 484–486, 52/488, 489, 518–527, 535, 536, 539, 543–547, 550, 552, 554, 555, 558, 559, 560, 702, 668, 778, 779, 483, 280–284, 665, 762; 403/387; 24/296, 458, 573

[56] References Cited

U.S. PATENT DOCUMENTS

| | | | |
|---|---|---|---|
| 1,252,781 | 1/1918 | Clark | 52/714 |
| 1,625,866 | 4/1927 | Pawling | 52/350 |
| 1,726,500 | 8/1929 | Norris | 52/145 |
| 2,170,483 | 8/1939 | Place | 24/458 |
| 3,076,536 | 2/1963 | Tinnerman | 403/187 |
| 3,187,854 | 6/1965 | Lydord | 403/387 |
| 3,253,082 | 5/1966 | Buset | 52/484 X |
| 3,292,332 | 12/1966 | Jahn | 52/484 |
| 3,602,955 | 9/1971 | Schwartz | 24/458 |
| 3,630,554 | 12/1971 | Cherniak | 52/713 |
| 3,677,589 | 7/1972 | Roles | 403/217 |
| 3,809,358 | 5/1974 | Hazeley | 248/317 |
| 4,559,751 | 12/1985 | Rogers | 52/665 |
| 4,598,521 | 7/1986 | Slapsys et al. | 52/484 |

FOREIGN PATENT DOCUMENTS

| | | | |
|---|---|---|---|
| 638660 | 3/1962 | Canada | 52/489 |
| 682819 | 3/1964 | Canada | 52/484 |
| 47852 | 9/1933 | Denmark | 52/550 |
| 3235957 | 3/1984 | Fed. Rep. of Germany | 52/665 |
| 1133870 | 4/1957 | France | 52/543 |
| 1227659 | 8/1960 | France | 52/483 |
| 1232421 | 10/1960 | France | 52/484 |
| 1263667 | 12/1961 | France | 52/486 |
| 324998 | 4/1953 | Switzerland | 52/484 |
| 324997 | 12/1957 | Switzerland | 24/296 |
| 941911 | 11/1963 | United Kingdom | 52/484 |
| 1530295 | 10/1978 | United Kingdom | 52/232 |
| 1544414 | 4/1979 | United Kingdom | 52/28 |

*Primary Examiner*—John E. Murtagh
*Assistant Examiner*—Andrew Joseph Rudy
*Attorney, Agent, or Firm*—Larson and Taylor

[57] ABSTRACT

A safety device is provided for combatting "wind load" on ceiling constructions in both upward and downward directions, particularly in ceilings of the type wherein flanged panels are supported from tee shaped panel carriers which are suspended from the ceiling. The safety device comprises an inverted U-shaped clip or wire which fits over the panel carrier so that the central portion of the clip bears against the horizontal upper surface of the associated panel carrier and the legs of the clip engage and support the corners of four panels which meet a point beneath the central portion of the clip. The free ends of the clip preferably include bent-up portions which engage in holes provided in the corresponding flanges of the panels.

4 Claims, 1 Drawing Sheet

SUPPORT CLIP FOR CEILING CONSTRUCTIONS

FIELD OF THE INVENTION

The present invention relates to ceiling constructions wherein ceiling panels are supported from tee bar or the like supports or carriers and, more particularly, to a clip device for combatting the effects of wind load and other forces on such ceiling constructions.

BACKGROUND OF THE INVENTION

The so-called "wind load" on a ceiling, i.e., the pressure exerted by high speed winds on such a ceiling, can be a serious problem in outdoor ceiling constructions such as are found in shopping centers, malls and the like. The wind speeds experienced can, of course, be considerable under hurricane and tornado conditions and the forces generated by such winds can pull the ceiling or parts thereof down. Moreover, ordinary high speed winds can also exert destructive forces on such ceilings. Wind can exert both upwardly and downwardly acting forces on ceilings and these forces are a particular problem in ceiling constructions of the type wherein ceiling panels are suspended from a tee bar or like support (i.e., wherein downwardly depending arms of a tee bar engage and support abutting upright flanges of adjacent ceiling panels) since if enough force is exerted it is possible to pull the panels down from, or otherwise dislodge the panels from, the supports. Other ceiling support arrangements present similar problems.

It is noted that forces similar to those produced by high speed winds can be exerted in other ways including the deliberate actions of vandals, and this can occur even in indoor facilities, such as prisons.

There are, of course, many patents in the field of ceiling constructions and many patents relating to support and/or retaining clips of various kinds including, for example: U.S. Pat. Nos. 1,625,866 (Pawling); 2,170,483 (Place); 3,076,536 (Tinnerman); 3,602,955 (Schwartz); 3,630,554 (Cherniak); 3,809,358 (Hazeley); and 3,823,675 (Farley).

SUMMARY OF THE INVENTION

In accordance with the invention, a safety or protective device is provided for combatting the effect of "wind load" forces, and other like forces, on ceiling constructions of the type described above, regardless of whether the force exerted on the ceiling construction is an upwardly or downwardly acting force. The safety device of the invention substantially increases the resistance of the ceiling construction to such forces while at the same time is extremely simple in construction and very easy to install and maintain.

According to a preferred embodiment thereof, the safety device of the invention comprises a clip member generally in the shape of an inverted U, the base or immediate portion of which engages, i.e., bears against, the upper surface of the tee bar panel carrier or other support and the free ends of the downwardly depending legs of which engage, and provide additional support for, the panels. In particular, the legs of the clip engage abutting flanges of respective pairs of the panels and, in a presentably preferred embodiment of the invention, engage in holes provided in these flanges.

Other features and advantages of the invention will be set forth in, or apparent from, the detailed description of a preferred embodiment which follows.

DESCRIPTION OF THE PREFERRED EMBODIMENT

Before discussing the preferred embodiments of the invention, reference is made to Table 1 below which sets out the wind loading provided on ceilings in pounds per square inch (exerted upwardly on the ceiling) as a function of wind speed in miles per hour and the height in feet of the ceiling above the ground.

TABLE 1

WIND LOAD CHART
In pounds per square foot (upward on the ceiling)

| HEIGHT ABOVE GROUND (FEET) | WIND SPEED IN M.P.H. 70 | 80 | 90 | 100 | 105 | 110 | 120 | 150 |
|---|---|---|---|---|---|---|---|---|
| 0–5 | 9 | 11 | 14 | 17 | 19 | 21 | 25 | 29 |
| 5–15 | 10 | 14 | 17 | 21 | 23 | 26 | 30 | 36 |
| 15–25 | 13 | 16 | 21 | 26 | 28 | 31 | 37 | 43 |
| 25–30 | 14 | 18 | 23 | 28 | 31 | 34 | 40 | 47 |
| 30–35 | 14 | 19 | 24 | 29 | 32 | 36 | 42 | 50 |
| 35–50 | 16 | 20 | 26 | 32 | 35 | 39 | 46 | 54 |
| 50–55 | 17 | 22 | 27 | 34 | 37 | 41 | 49 | 57 |
| 55–75 | 18 | 23 | 29 | 36 | 40 | 43 | 52 | 61 |
| 70–100 | 19 | 25 | 32 | 39 | 43 | 47 | 56 | 66 |

As will be noted from the chart, the loading produced can be considerable and as discussed above, can be a serious problem. Again, although combatting wind load is a primary purpose of the invention, the invention is not limited to such an application.

Figure 1:
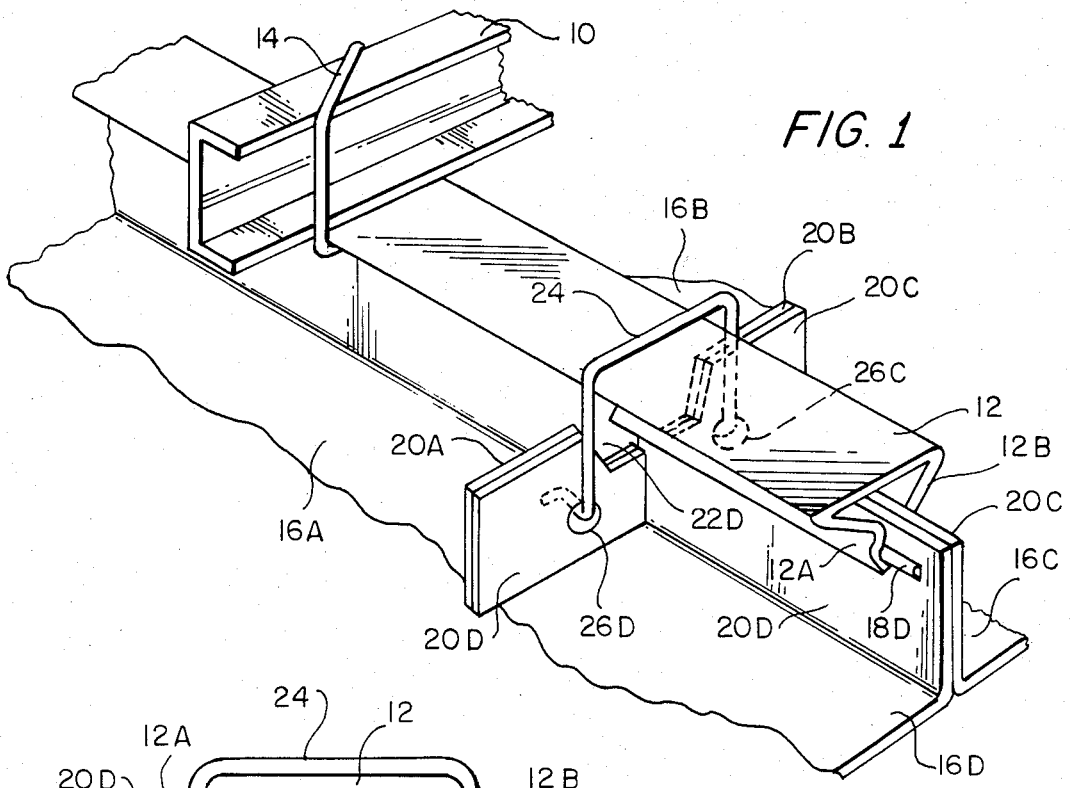
FIG. 1 is a perspective view of the key components of a ceiling construction incorporating the wind load protection device of the invention.
Figure 2:
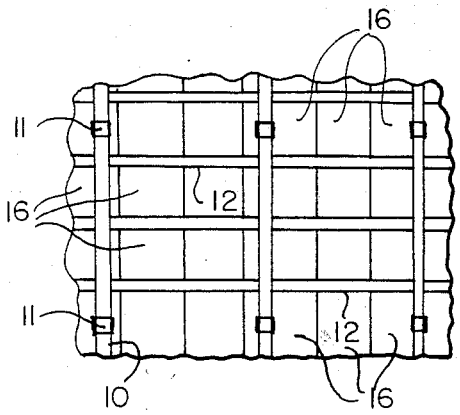
FIG. 2 is schematic plan view of the overall ceiling construction showing the layout of the component members.

Referring to FIG. 1, selected components of a ceiling construction incorporating the clip device of the invention are shown. The ceiling construction includes a series of horizontal channel shaped members or channels, a portion of one of which, denoted 10, is shown in FIG. 1, and which are arranged in spaced parallel relation. In a typical non-limiting example, the horizontal channels 10 are 1½ inch channels and are spaced apart 3 feet, 4 inches. The overall ceiling construction is shown in FIG. 2, and as is illustrated schematically in that figure, the channels 10 are supported from the ceiling by vertically extending struts 11 which, in the exemplary embodiment under consideration, are spaced apart in the direction of the channels every 4 feet. Channels 10, in turn, support a plurality of spaced, parallel tee bar panels carriers 12 which extend orthogonally to channels 10 as shown in FIG. 2 and one of which is shown in FIG. 1. In a non-limiting example, the tee shaped panel carriers 12 are spaced apart 1 foot, 6 9/16 inches. The panel carriers 12 can be supported by the channels 10 in any suitable manner and, in FIG. 1, a wire clip is indicated at 14 which serves this purpose.

Figure 3:
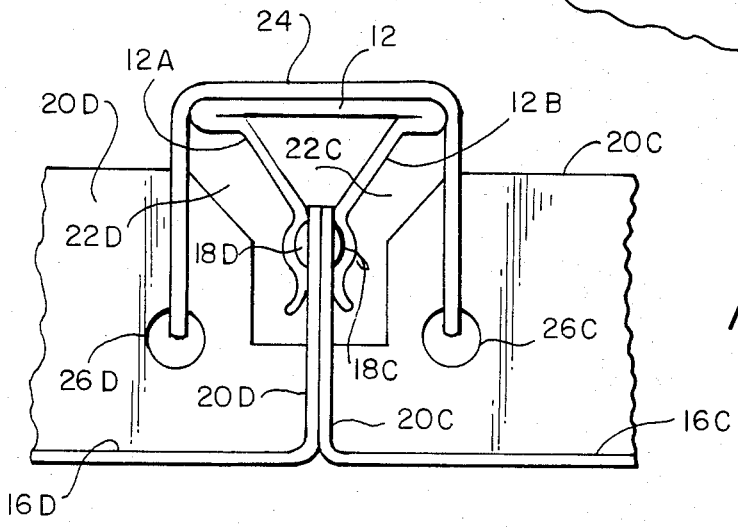
FIG. 3 is an end elevational view, to enlarged scale, of a portion of the ceiling construction of FIG. 1.

A plurality of ceiling panels, which are generally denoted 16, (and are individually denoted 16A, 16B, 16C and 16D in FIG. 1) are supported from tee bar panel carriers 12, in a manner which can perhaps be best shown in FIG. 3. In the exemplary embodiment under consideration, panels 16 are square in shape and are 1 foot, 6 9/16 inches on a side. As illustrated in FIG. 3, tee bar panel carrier 12 includes downwardly depending spring arms 12A and 12B which are biased inwardly toward one another and which are adapted to engage an elongate raised rib or bead 18, which extends longitudinally along the inner walls of an upright flange portion or flange 20 of panel 16 and which is, in a preferred embodiment, punched out of the flange. Each panel 16 includes four such flanges 20, and the outer walls of the flanges 20 abut corresponding outer walls of the flanges of adjacent panels. To explain, considering the panels denoted 16A, 16B, 16C and 16D which are shown in FIG. 1, and considering panel 16D as exemplary, one lateral upstanding flange 20D abuts a corresponding flange 20A of panel 16A and a further lateral upstanding flange 20D, containing rib 18D, abuts a corresponding flange 20C of panel 16C. As can best be seen in FIG. 1, the flanges 20D of panel 16D include notches 22D at the ends thereof. As shown in FIG. 3, the notches 22D and 22C of aligned flanges 20D and 20C permit receipt of spring arms 12A and 12B of panel carrier 12 in the space provided by these notches. It will be understood that, referring to FIG. 3, the spring arms 12A and 12B of tee bar panel carrier 12 are shaped, as illustrated, to engage the ribs 18D and 18C of the abutting flanges 20D and 20C of panels 16D and 16C and snap over these ribs 18D and 18C so that panels 16D and 16C are secured together by these arms and suspended from panel carrier 12.

Figure 4:
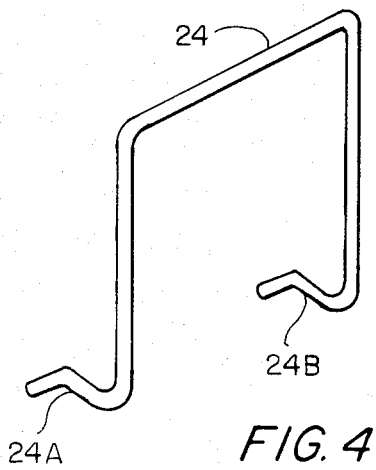
FIG. 4 is a perspective view of the wire clip which constitutes the wind load protection device of the invention.

The foregoing description is intended to provide a background for the present invention which concerns the provision of a safety device for combatting wind load and like forces acting on a ceiling construction such as has been described. The safety device basically comprises a wire clip which is denoted 24 in FIGS. 1 and 3. The clip 24 is also illustrated in FIG. 4, which figure shows the clip 24 alone and thus better illustrates the overall shape thereof. As shown in FIG. 4, the clip 24 is substantially U-shaped and includes curved bent-up or hooked portions 24A and 24B at the free ends of the legs thereof. As shown in FIGS. 1 and 3, these curved portions 24A and 24B respectively extend through holes 26D and 26C in flanges 20D and 20C of panels 16D and 16C, and corresponding aligned holes in the abutting flanges 20A and 20B of panels 16A and 16B, and thereby provide engagement of the clip 24 with all of these flanges so as to provide capture of the corners of all four panels 16A to 16D. As illustrated, clip 24 fits over tee bar panel carrier 12 such that the base or intermediate portion of clip 24 engages and bears against the upper surface of panel carrier 12 while the hook portions 24A and 24B of clip 24 provide engagement with flanges 20D, 20C and 20A, 20B, respectively, as discussed above.

As set forth hereinbefore, the basic purpose of clip 24 is to prevent the panels 16 from being blown up or down due to "wind load" or other pressures thereon due to external forces. This relatively simple arrangement provides capture of the corners of all four abutting panels (16A to 16D) and supports these panels on panel carrier 12 in a manner such as to provide resistance to both downdrafts and updrafts as well as to other forces acting in a similar manner.

Although the present invention has been described relative to an exemplary embodiment thereof, it will be understood by those skilled in the art that variations and modifications can be effected in this exemplary embodiment without departing from the scope and spirit of the invention.

I claim:

1. A ceiling construction comprising a plurality of panels having lateral edges and corners, said panels intersecting at the corners to form a ceiling, each of said panels having upstanding flanges at the lateral edges thereof, said flanges having abutting and non-abutting sides and the abutting sides of the flanges abutting with respective abutting sides of the flanges of adjacent panels, and a plurality of a generally tee shaped panel support members each having longitudinal axis and each including an upper transversely extending portion having an upper surface and a pair of downwardly depending arms which engage non-abutting sides of respective abutting flanges of a pair of adjacent panels, said respective flanges extending parallel to the longitudinal axis of the panel support member, and said ceiling construction further including a clip device for increasing resistance of the ceiling construction to wind loading, said clip device comprising a U-shaped clip disposed at an intersection of the corners of four said panels and comprising a base portion bearing against the upper surface of the transversely extending portion of a said panel support member in an area located substantially directly above respective pairs of abutting flanges of adjacent panels which extend orthogonally to the longitudinal axis of said panel support member, a pair of downwardly depending legs having free ends, and flange engaging means, located at the free ends of the legs, for engaging said respective pairs of abutting flanges of adjacent panels which extend orthogonally to the longitudinal axis of said panel support member.

2. A ceiling construction panel as claimed in claim 1 wherein said abutting flanges which extend orthogonally include holes therein and said flange engaging means comprise curved portions of the legs of said clip formed at the free ends of the said legs which engage in said holes.

3. In a ceiling construction wherein a plurality of ceiling panels, having lateral edges and having upright flanges at the lateral edges thereof, are supported in edge to edge relationship so that the flanges of adjacent panels abut and a plurality of transversely extending support members which engage abutting flanges of adjacent panels to support the panels, means for providing additional support for the panels and add resistance to both upwardly and downwardly directed forces acting on the panels, said means comprising a clip member comprising an intermediate base portion which bears against the support member and spaced leg portions which depend perpendicularly downwardly from said base portion to locations directly adjacent to respective abutting flanges of adjacent pairs of said panels and which have free ends that respectively engage said abutting flanges of adjacent pairs of said panels.

4. A ceiling construction as claimed in claim 3 wherein the abutting flanges of said adjacent pairs of said panels include aligned holes therein in which the respective free ends of said leg portions engage.

* * * * *